US008333447B2

(12) United States Patent
Moody

(10) Patent No.: US 8,333,447 B2
(45) Date of Patent: Dec. 18, 2012

(54) BASKET KICK-OUT

(75) Inventor: William Lee Moody, Anderson, SC (US)

(73) Assignee: Electrolux Home Products, Inc., Cleveland, OH (US)

( * ) Notice: Subject to any disclaimer, the term of this patent is extended or adjusted under 35 U.S.C. 154(b) by 351 days.

(21) Appl. No.: 12/394,670

(22) Filed: Feb. 27, 2009

(65) Prior Publication Data

US 2010/0218545 A1 Sep. 2, 2010

(51) Int. Cl.
*A47B 88/02* (2006.01)

(52) U.S. Cl. ..... 312/404; 312/301; 312/402

(58) Field of Classification Search ..... 312/402, 312/404, 408, 301, 330.1, 410, 273, 295, 312/310, 401, 405, 405.1, 228.1, 298; 211/41.4, 211/85.31, 126.15, 153, 133.5, 133.2, 126.8–126.9, 211/181.1; 62/382, 377, 340; 126/337, 339, 126/332, 337 R, 337 A
See application file for complete search history.

(56) References Cited

U.S. PATENT DOCUMENTS

| | | | | |
|---|---|---|---|---|
| 2,103,885 | A * | 12/1937 | Whalen | 312/404 |
| 2,319,470 | A * | 5/1943 | Nobles | 211/153 |
| 2,711,944 | A * | 6/1955 | Meek et al. | 312/333 |
| 2,745,707 | A * | 5/1956 | Sebens | 312/311 |
| 2,893,805 | A * | 7/1959 | Ferguson | 312/402 |
| 3,212,835 | A * | 10/1965 | Beckett et al. | 312/311 |
| 3,594,058 | A * | 7/1971 | Kauffman | 312/298 |
| 4,657,148 | A * | 4/1987 | Heng | 211/126.12 |
| 5,123,537 | A * | 6/1992 | Gresens | 206/511 |
| 5,249,590 | A * | 10/1993 | Jacobus et al. | 134/135 |
| 5,980,009 | A | 11/1999 | Atalla et al. | |
| 6,279,467 | B1 * | 8/2001 | Tiemann | 99/426 |
| 6,491,173 | B1 | 12/2002 | Costa | |
| 2005/0127804 | A1 * | 6/2005 | Kim et al. | 312/402 |
| 2006/0049731 | A1 * | 3/2006 | Choi et al. | 312/330.1 |
| 2006/0113260 | A1 * | 6/2006 | Purushothaman et al. | 211/41.8 |
| 2006/0266070 | A1 | 11/2006 | Ertz et al. | |
| 2007/0018548 | A1 * | 1/2007 | Ertz et al. | 312/402 |

(Continued)

FOREIGN PATENT DOCUMENTS

JP 2006141797 A * 6/2006

OTHER PUBLICATIONS

Machine Translation of JP 2006-141797.*

(Continued)

*Primary Examiner* — James O Hansen
*Assistant Examiner* — Sasha T Varghese
(74) *Attorney, Agent, or Firm* — Pearne & Gordon LLP

(57) ABSTRACT

An appliance is provided that includes a storage compartment comprising a first storage bin and a second storage bin configured to move relative to the storage compartment along a parallel path of movement, a first tab located on the first storage bin, and a second tab located within a perimeter of a surface of the second storage bin. The second tab is in a location that is configured to interact with the first tab at a point along the parallel path of movement. The second storage bin moves simultaneously with the first storage bin while the first tab interacts with the second tab. Either the first storage bin or the second storage bin can be placed in the storage compartment in at least a first orientation and a second orientation, where the second orientation disables the second storage bin from moving simultaneously with the first storage bin.

19 Claims, 7 Drawing Sheets

U.S. PATENT DOCUMENTS

| | | | | |
|---|---|---|---|---|
| 2007/0035221 | A1 | 2/2007 | Koo | |
| 2007/0245762 | A1 | 10/2007 | Maglinger et al. | |
| 2008/0018215 | A1* | 1/2008 | Carden et al. | 312/404 |
| 2008/0047916 | A1* | 2/2008 | Klingspor et al. | 211/153 |
| 2008/0088213 | A1 | 4/2008 | Klein et al. | |
| 2009/0066207 | A1* | 3/2009 | Laible | 312/404 |

OTHER PUBLICATIONS

International Search Report for PCT/US2010/025019 dated Jan. 10, 2011, 2 pages.

* cited by examiner

BASKET KICK-OUT

BACKGROUND OF THE INVENTION

The present invention relates generally to a storage compartment of an appliance, such as a refrigerator-freezer. It is generally known in the prior art that a storage compartment of an appliance includes a plurality of drawers or baskets that can slide in and out of the storage compartment.

Typical bottom-mount household refrigerators include a fresh food compartment located at the upper portion of the refrigerator, where food items can be stored at temperatures above 0° Celsius, and a freezer compartment located at the lower portion of the refrigerator, where food items can be maintained at temperatures substantially below 0° Celsius. Various door or closure constructs are provided for closing the fresh food compartment and freezer compartment. For example, a single door hinged to the refrigerator cabinet can be employed to close off and provide access to the interior of the fresh food compartment. In addition, French-style doors hinged to the refrigerator cabinet can be used for the same purpose. In the case of the freezer compartments, doors can be provided that allow the opening to the interior of the freezer compartment to be opened and closed by movement of the doors substantially translational to the freezer door opening. In other words, the doors slide outwardly from and inwardly toward the freezer compartment opening to provide access to the interior of the freezer compartment and to close the freezer compartment respectively. The doors can have attached to them bins, baskets and the like that travel with the doors as the doors are pulled outwardly from the freezer compartment opening and pushed inwardly toward the opening to close the freezer compartment. Bins, baskets and the like also can be provided in the freezer compartment that do not travel with the doors but must be separately brought outwardly from the interior of the fresh food compartment for access.

In some prior art designs, the upper basket within the storage compartment was not visible when the drawer was opened because the basket remained inside the cabinet and the fresh food doors obstructed the line of sight to the basket when standing directly in front of the appliance. It is thus desirable to provide an upper basket that can be adjusted such that the user can decide whether the upper basket is movable with the door or whether the basket will remain inside the appliance compartment.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect of the present invention, an appliance is provided that includes a storage compartment comprising a first storage bin configured to move relative to the storage compartment, a second storage bin configured to move relative to the storage compartment, a first tab located on the first storage bin, and a second tab located within a perimeter of a surface of the second storage bin. The second tab is in a location that is configured to interact with the first tab at a point along a path of movement of the first storage bin.

The second storage bin moves simultaneously with the first storage bin while the first tab interacts with the second tab.

In accordance with another aspect of the present invention, an appliance is provided that includes a storage compartment comprising a first storage bin configured to move relative to the storage compartment, a second storage bin configured to move relative to the storage compartment along a path of movement located above the first storage bin, a first tab located on the first storage bin, and a second tab located on a bottom surface of the second storage bin. The second tab is in a location that interacts with the first tab at a point along the path of movement. The second storage bin moves simultaneously with the first storage bin while the first tab interacts with the second tab.

In accordance with another aspect of the present invention, an appliance is provided that includes a storage compartment comprising a first storage bin configured to move relative to the storage compartment, a second storage bin configured to move relative to the storage compartment along a parallel path of movement to the first storage bin, a first tab located on the first storage bin, and a second tab located within a perimeter of a surface of the second storage bin. The second tab is in a location that is configured to interact with the first tab at a point along the parallel path of movement. The second storage bin moves simultaneously with the first storage bin while the first tab interacts with the second tab. The second storage bin includes a first side, a second side, a third side, and a fourth side. The second storage bin is configured to be placed in the storage compartment in at least a first orientation and a second orientation. The first orientation for the second storage bin includes the first side being a leading side and the fourth side being a trailing side. The second orientation for the second storage bin includes the fourth side being the leading side and the first side being the trailing side. Placement of the second storage bin in the second orientation in the storage compartment disables the second storage bin from moving simultaneously with the first storage bin. The second orientation of the second storage bin adjusts the location of the second tab relative to the first tab such that the first tab and the second tab are unable to interact with each other during the parallel path of movement of the second storage bin.

BRIEF DESCRIPTION OF THE SEVERAL VIEWS OF THE DRAWINGS

The foregoing and other aspects of the present invention will become apparent to those skilled in the art to which the present invention relates upon reading the following description with reference to the accompanying drawings, in which.

DETAILED DESCRIPTION OF THE INVENTION

Figure 1:
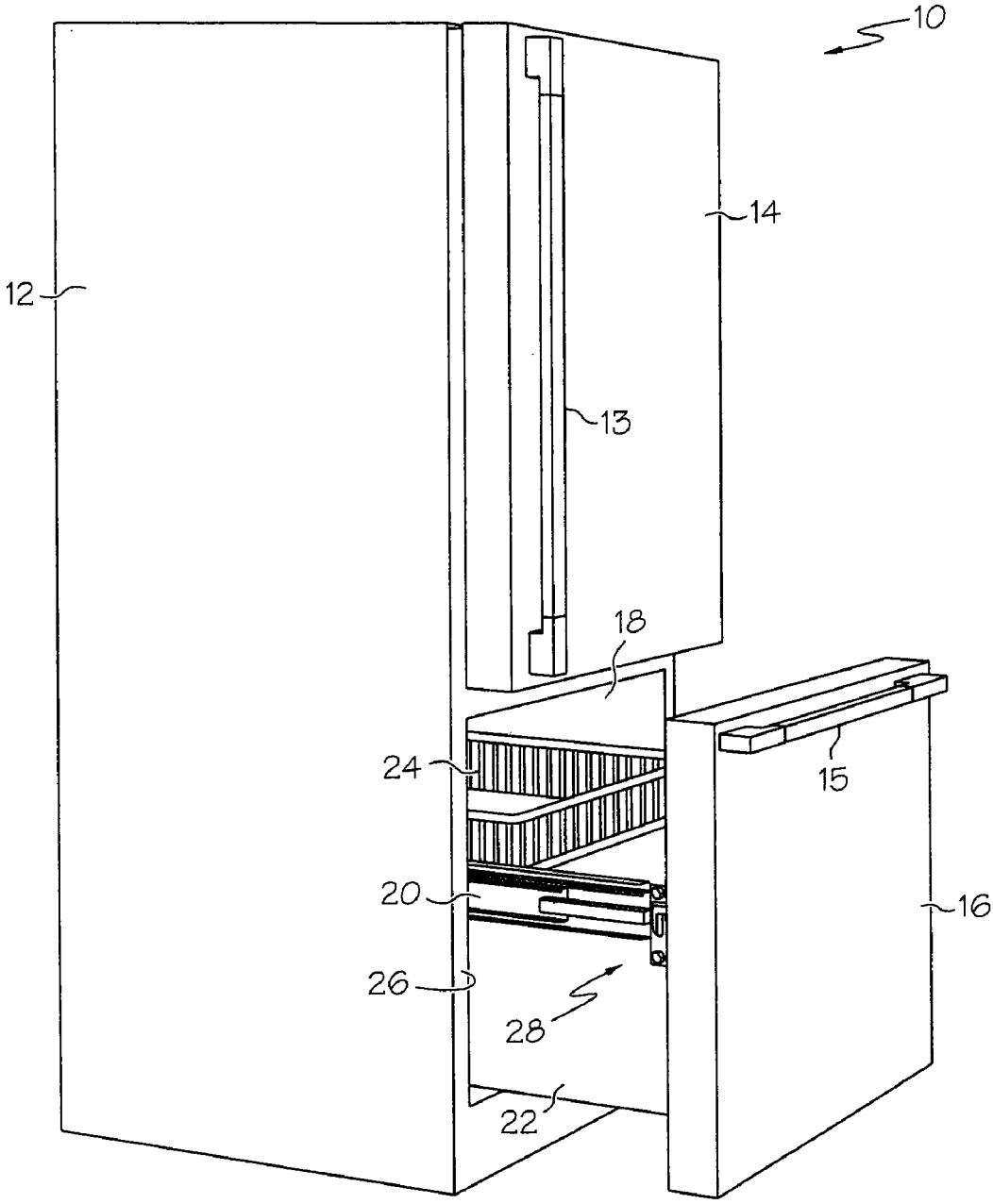
FIG. 1 is a perspective view of an appliance in which a first storage bin and a second storage bin are provided.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

As shown in FIG. 1, a household appliance 10 is provided. The appliance can be a household bottom-mount refrigerator, though other appliances can also be used that include a storage compartment 12. The appliance includes a storage compartment 12 that houses at its upper portion a fresh food compartment that is typically maintained at a temperature of greater than 0° Celsius and at its lower portion a freezer compartment that is typically maintained at a temperature substantially below 0° Celsius. A door 14 is hinged at one side of the storage compartment 12 opposite a handle 13 and closes off an opening at the front of the fresh food compartment through which access can be had to the interior of the fresh food compartment. A door 16 is provided that closes off an opening 18 of the storage compartment 12 at the front of the freezer compartment through which access can be had to the interior of the freezer compartment. The door 16 can be supported by telescoping sliding rails 20 located at each side 28 of the door 16 and is mounted to the interior side walls 26 of the freezer compartment in a manner familiar to those having ordinary skill in the art so that the freezer compartment can be opened by sliding the door 16 out from the opening 18 and closed by sliding the door 16 in toward the opening 18 by means of the sliding rails 20. A handle 15 can be provided for moving the door 16. The freezer compartment thus comprises an enclosure including the opening 18 providing access to the interior of the enclosure. Stated otherwise, the enclosure from which the door 16 is supported comprises a freezer compartment of a bottom-mount household refrigerator and the door 16 is configured to open and close the opening 18 in the enclosure at least in part by substantially translational movement relative to the opening 18 away from and toward the opening 18.

A first storage bin 22 and a second storage bin 24 can be provided within the freezer compartment of the appliance 10. In this example, the first storage bin 22 is larger than the second storage bin 24 but it is appreciated that in other examples various shapes and sizes can be used for both the first storage bin 22 and the second storage bin 24. The first storage bin 22 and the second storage bin 24 are configured to move relative to the storage compartment. For example, the storage bins 22, 24 can move in a plurality of different directions and orientations relative to the storage compartment to provide access to a user. In one example, the storage bins 22, 24 can move generally in and out of the storage compartment. The first storage bin 22 can be a storage basket or can be a storage container as shown though other storage mechanisms or shelves can also be used. The second storage bin 24 can be located above the first storage bin 22 though other arrangements for multiple storage bins can be used such as the storage bins 22, 24 being located side-by-side or at various angles relative to each other. The second storage bin 24 can be a storage basket, as shown, or can be a storage container though other storage mechanisms or shelves can also be used. It is appreciated that either the first storage bin 22 or the second storage bin 24 can also be a wire basket. A variety of storage bins, such as bins and baskets, can be attached to the door 16 and supported by telescoping sliding rails 20, 30 or the like so that they travel with the door as it is opened and closed. For example, two storage bins can be located below the second storage bin 24. Other numbers of storage bins can also be located in the freezer compartment. In some examples, each of the storage bins can move independently of the movement of the door 16. The door 16, the first storage bin 22 and the second storage bin 24 can be supported by sliding or gliding mechanisms of various types including telescoping or sliding rail mechanisms.

Figure 2:
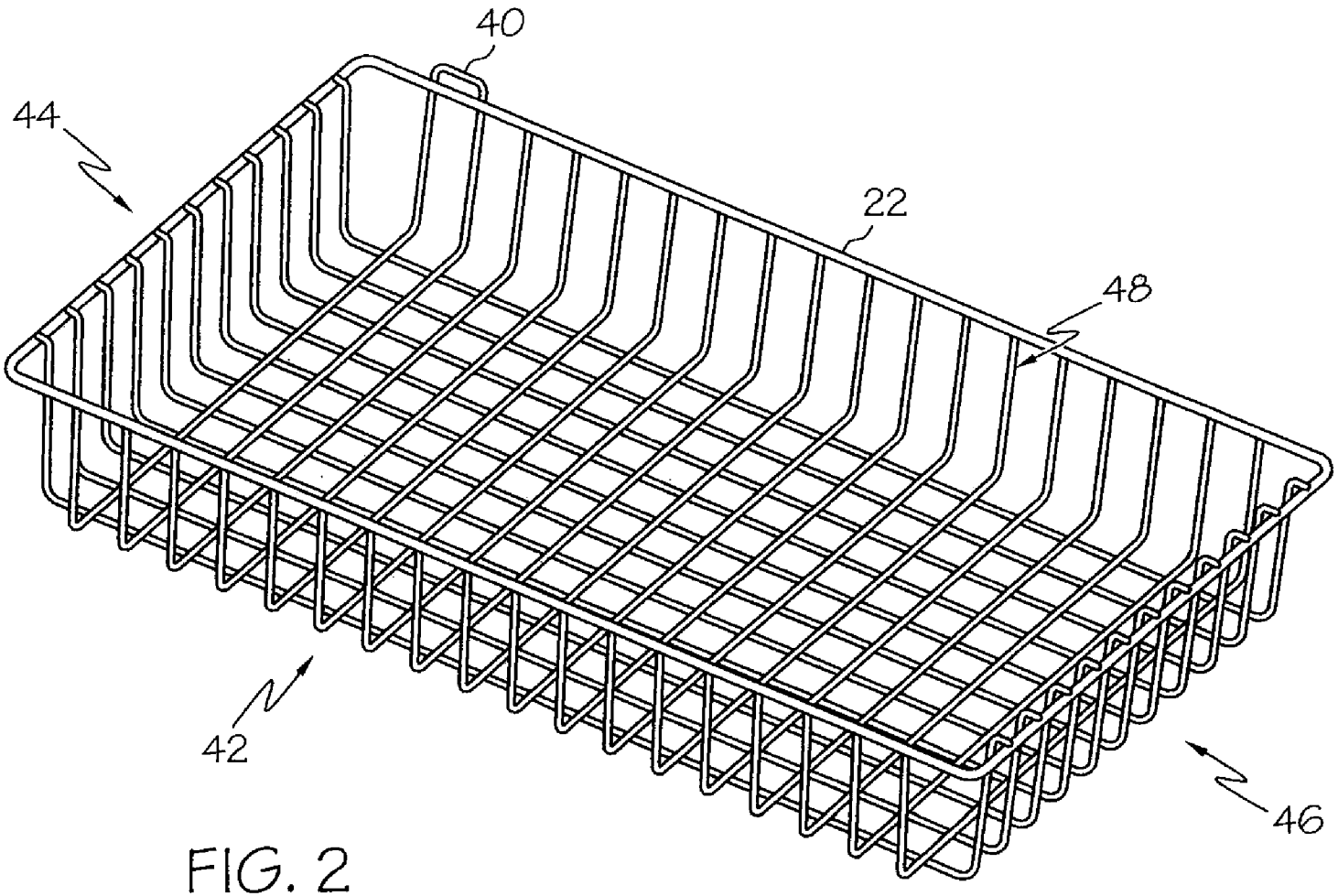
FIG. 2 is a perspective view of the first storage bin of FIG. 1.

In FIG. 2, the first storage bin 22 is shown. A first tab 40 is located on the first storage bin 22. The first tab 40 can be in a number of locations, such as on a top surface, a side surface, a bottom surface, or even an interior surface. The first tab 40 can be located on a perimeter of any of these surfaces or in any location on any of these surfaces within the perimeter. The first tab 40 can be a wire formed in various shapes or can be a solid object formed in various shapes. In this example, the first tab 40 is in the form of an outline of a rectangle. The first storage bin 22 can include a first side 42, a second side 44, a third side 46, and a fourth side 48. The first storage bin 22 can be slidably movable along the second side 44 and the third side 46. The first tab 40 can be located between the second side 44 and the third side 46. In other examples, the first tab 40 can be located along one of the first side 42 and the fourth side 48. In the shown example, the first tab 40 can be located on a left portion of the fourth side 48 of the first storage bin 22. In any of the locations, the first tab 40 can extend upwards above the other portions of the first storage bin 22.

Figure 3:
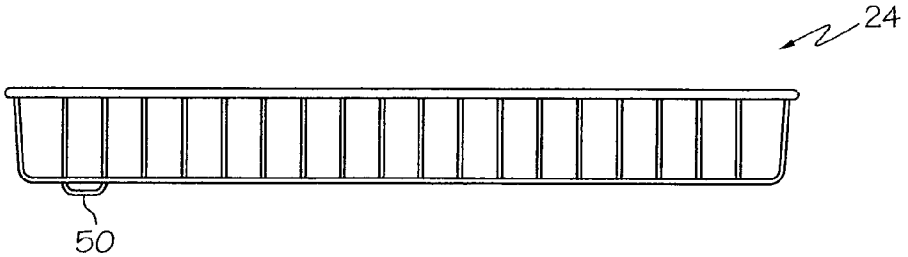
FIG. 3 is a front view of the second storage bin of FIG. 1.

In FIG. 3, a front view of the second storage bin 24 is shown. A second tab 50 can be located within a perimeter of a surface of the second storage bin 24. Depending on the orientation of the second storage bin 24 relative to the first storage bin 22, the second tab 50 can be located along a bottom surface, as shown in FIG. 3, or the second tab 50 can be located within a perimeter of the front surface, or the second tab 50 can be located within a perimeter of any other surface of the second storage bin 24, such as a side surface. The second tab 50 can be located on a left portion of the second storage bin 24, as shown in FIG. 3. The second tab 50 is in a location that is configured to interact with the first tab 40 at a point along the path of movement of the second storage bin 24. The second tab 50 can be a wire formed in various shapes or can be a solid object formed in various shapes. The second tab 50 can extend downwards below the other portions of the second storage bin 24.

Figure 4:
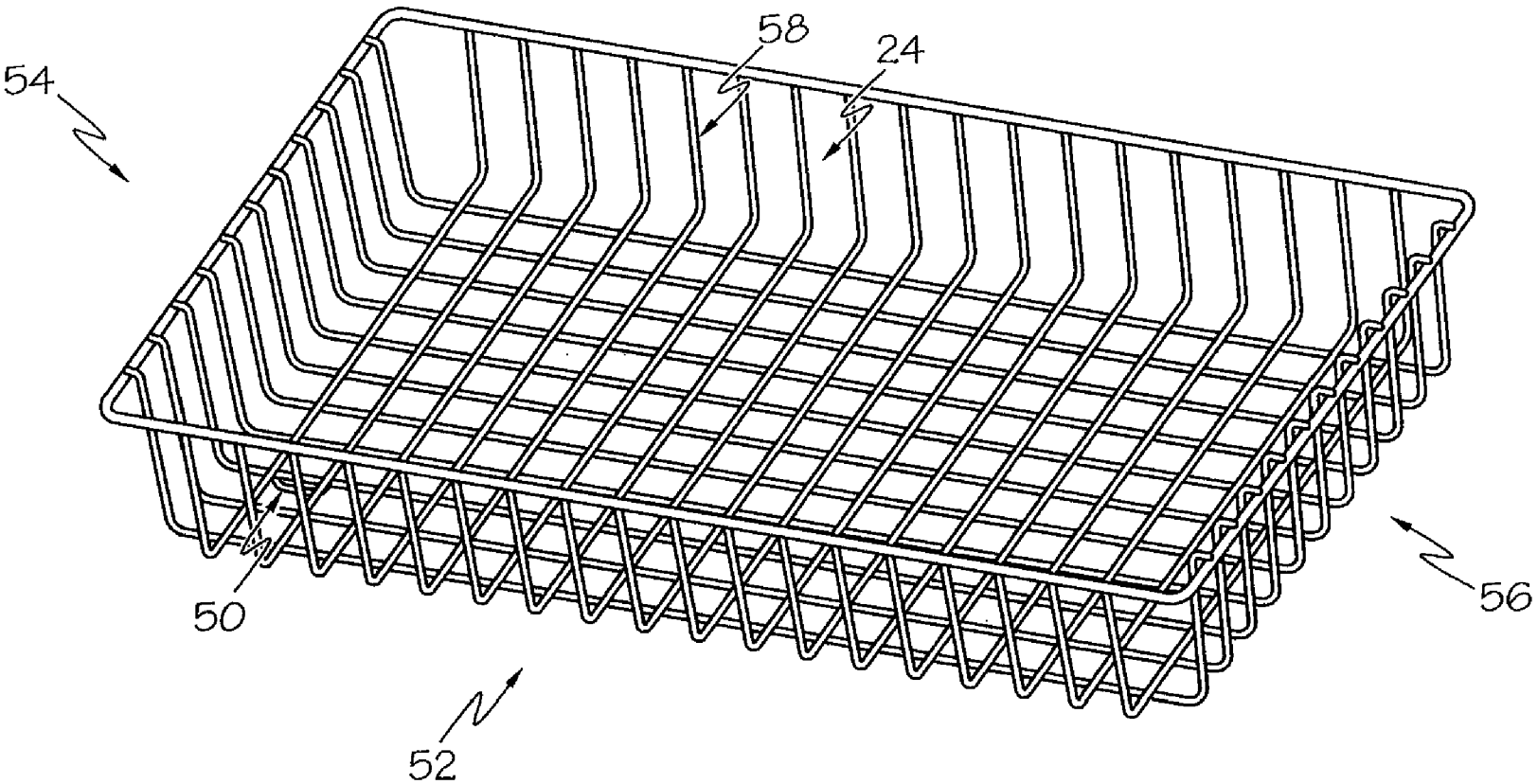
FIG. 4 is a perspective view of the second storage bin of FIG. 3.

As shown in FIG. 4, a perspective view of the second storage bin 24 is provided. The second storage bin 24 can include a first side 52, a second side 54, a third side 56, and a fourth side 58. The second storage bin 24 can be slidably movable along the second side 54 and the third side 56. The second tab 50 can be located between the second side 54 and the third side 56. The second tab 50 can also be located along one of the first side 52 and the fourth side 58. In another example, the second tab 50 can be defined as being located between the first side 52, the second side 54, the third side 56, and the fourth side 58. In the shown example, the second tab 50 can be located on a left portion within the perimeter of the bottom surface of the second storage bin 24.

Figure 5:
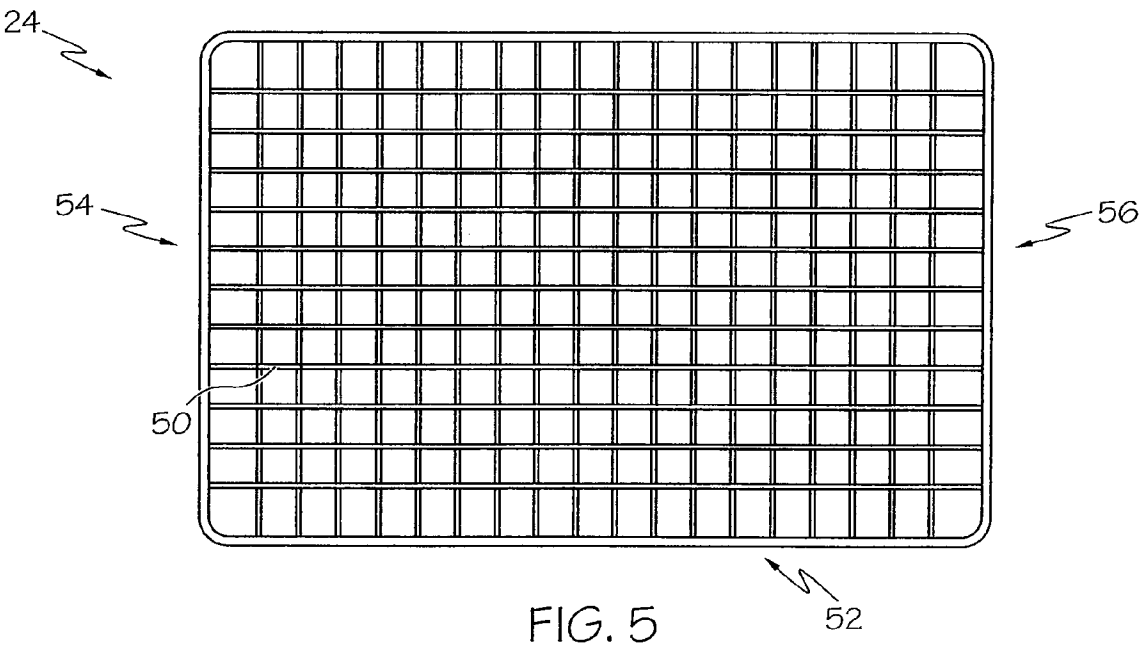
FIG. 5 is a bottom view of the second storage bin of FIG. 3.

As shown in FIG. 5, a bottom view of the second storage bin 24 is provided. The second tab 50 can be located within a middle area of the second storage bin 24 but can be in a location that is closer to the first side 52, such as the front of the second storage bin 24. It is appreciated that the second tab 50 can be in the same location even if the storage bin is not a storage basket and is some other type of solid object.

Figure 6:
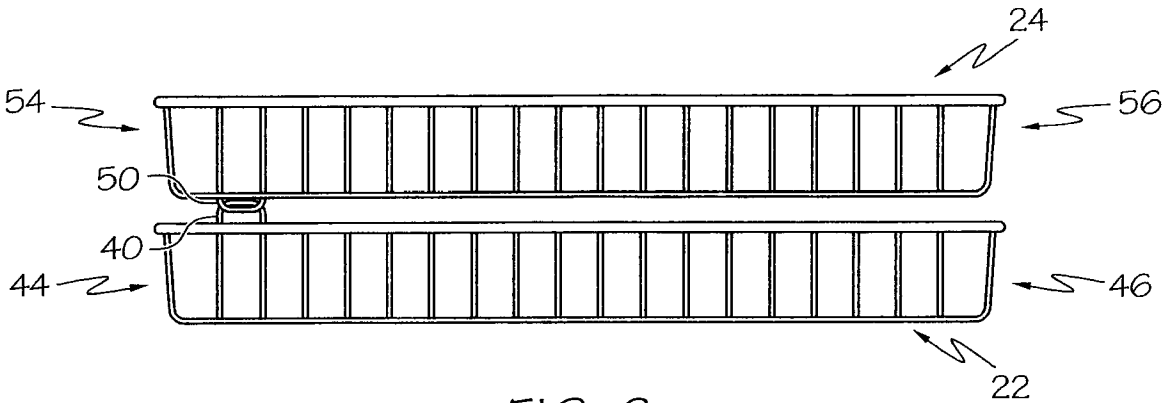
FIG. 6 is a front view of the first storage bin and the second storage bin of FIG. 1 when the second storage bin is in a first orientation.

In FIG. 6, an example view of the interaction between the first tab 40 of the first storage bin 22 and the second tab 50 of the second storage bin 24 is shown. When the first storage bin 22 moves relatively outwards from the storage compartment, either by movement of the door 16 or by manual movement by a user, the first tab 40 will eventually interact with the second tab 50 by contacting the first tab 40. The second storage bin 24 moves simultaneously with the first storage bin 22 while the first tab 40 interacts with the second tab 50. The contact between the first tab 40 and the second tab 50 allows the second storage bin 24 to be moved relatively outwards from the compartment along with the first storage bin 22. Upon interaction or contact between the first tab 40 and the second tab 50, the first storage bin 22 will be unable to move any additional amount without also causing a similar movement of the second storage bin 24. As FIG. 6 shows, the first tab 40 and the second tab 50 are in locations that allow them to interact, as shown by the second tab 50 being located in front of the first tab 40. The first tab 40 and the second tab 50 can be in other locations within the first storage bin 22 and the second storage bin 24. For example, if the second tab 50 is located closer to the first side 52 of the second storage bin 24, the first storage bin 22 must reach almost full extension from the storage compartment before the first tab 40 interacts with the second tab 50. This arrangement results in the second storage bin 24 being pulled relatively out of the storage compartment at a later time. Accordingly, if the second tab 50 is located closer to the fourth side 58 of the second storage bin 24, the first tab 40 will interact with the second tab 50 almost immediately after the first storage bin 22 begins to move. The second tab 50 can also be in any location between the first side 52 and the fourth side 58.

As shown in FIG. 6, the first tab 40 and the second tab 50 can be in locations offset from the center of each basket in the front view. By providing the first tab 40 and the second tab 50 in an offset location, a user can disable the automatic movement of the second storage bin 24 with the first storage bin 22 by placing the second storage bin 24 in the freezer compartment in a second orientation. The second storage bin 24 can be configured to be placed in the opening 18 of the storage compartment in a first orientation or in a second orientation. The first orientation for the second storage bin 24 can include the first side 52 being a leading side and the fourth side 58 being a trailing side. The leading side corresponds to the side closest to a user of the appliance. Thus, the leading side refers to the side that will be the first to move from the storage compartment. The second orientation for the second storage bin 24 can include the fourth side 58 being the leading side and the first side 52 being the trailing side.

FIG. 6 shows an example of the second storage bin 24 in the first orientation. The second side 54 is located on the left and the third side 56 is located on the right which corresponds to the orientation shown in FIG. 4. In this first orientation, the second tab 50 is in a location such that it will contact the first tab 40 upon the first storage bin 22 being moved from the storage compartment.

Figure 7:
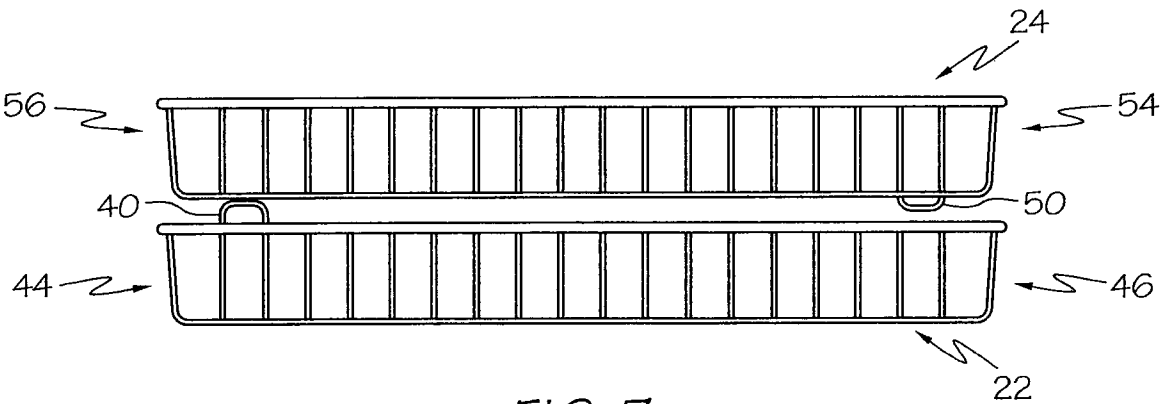
FIG. 7 is a front view of the first storage bin and the second storage bin of FIG. 1 when the second storage bin is in a second orientation.

FIG. 7 shows an example of the second storage bin 24 in the second orientation. In this example second orientation, the second side 54 is located on the right and the third side 56 is located on the left. Thus, this orientation will have the first side 52, shown in FIG. 4, being the trailing side, and the fourth side 58 being the leading side. In this second orientation, the second tab 50 is in a location such that it will not contact the first tab 40 upon movement of either the first storage bin 22 or the second storage bin 24. In some examples, the second tab 50 can interact with the first tab 40 at a point along the path of movement of the first storage bin 22 only when the second storage bin 24 is in the first orientation. The second orientation of one of the storage bins, such as the second storage bin 24, can adjust the location of the second tab 50 such that the first tab 40 and the second tab 50 are unable to interact with each other during the path of movement of the second storage bin 24. In the example shown, the path of movement of the storage bins 22, 24 are parallel to each other, though in other examples, the movements can be different and do not require a parallel movement. Only when both the first storage bin 22 and the second storage bin 24 are each in the proper orientation will the second storage bin 24 move at the same time as the first storage bin 22.

By providing at least one of the first storage bin 22 and the second storage bin 24 with at least two orientations, one of the storage bins can be adjusted by a user to disable or prevent the first storage bin 22 and the second storage bin 24 from moving simultaneously. A number of different orientations can be provided. For example, a square-shaped storage bin could be inserted into the storage compartment with any of its sides being the leading side. In a further example, the second orientation, such as a reverse orientation of the first orientation where the second storage bin is placed in the storage compartment in the reverse or opposite manner, will disable the second storage bin from moving simultaneously with the first storage bin. The reverse placement of one of the storage bins, such as the second storage bin 24, in a reverse orientation in the storage bin disables the second storage bin 24 from moving simultaneously with the first storage bin 22. In one example, any second orientation, such as a reverse orientation, can adjust the location of the first tab 40 relative to the second tab 50 such that the first tab 40 and the second tab 50 are unable to interact with each other during the path of movement of the second storage bin 24. In another example, the second orientation can adjust the location of the second tab 50 relative to the first tab 40 such that the first tab 40 and the second tab 50 are unable to interact with each other during the path of movement of the second storage bin 24. In the example of FIG. 7, the second orientation results in the second tab 50 being located on a right side of the second storage bin 24. When the second tab 50 is on the right side, it will not be in a location that engages or contacts the first tab 40 of the first storage bin 22. Thus, the second storage bin 24 will no longer be displaced when the first storage bin 22 is displaced. In other examples, the first storage bin 22 can be placed in the storage compartment in a number of different orientations, including a reverse orientation.

Figure 8:
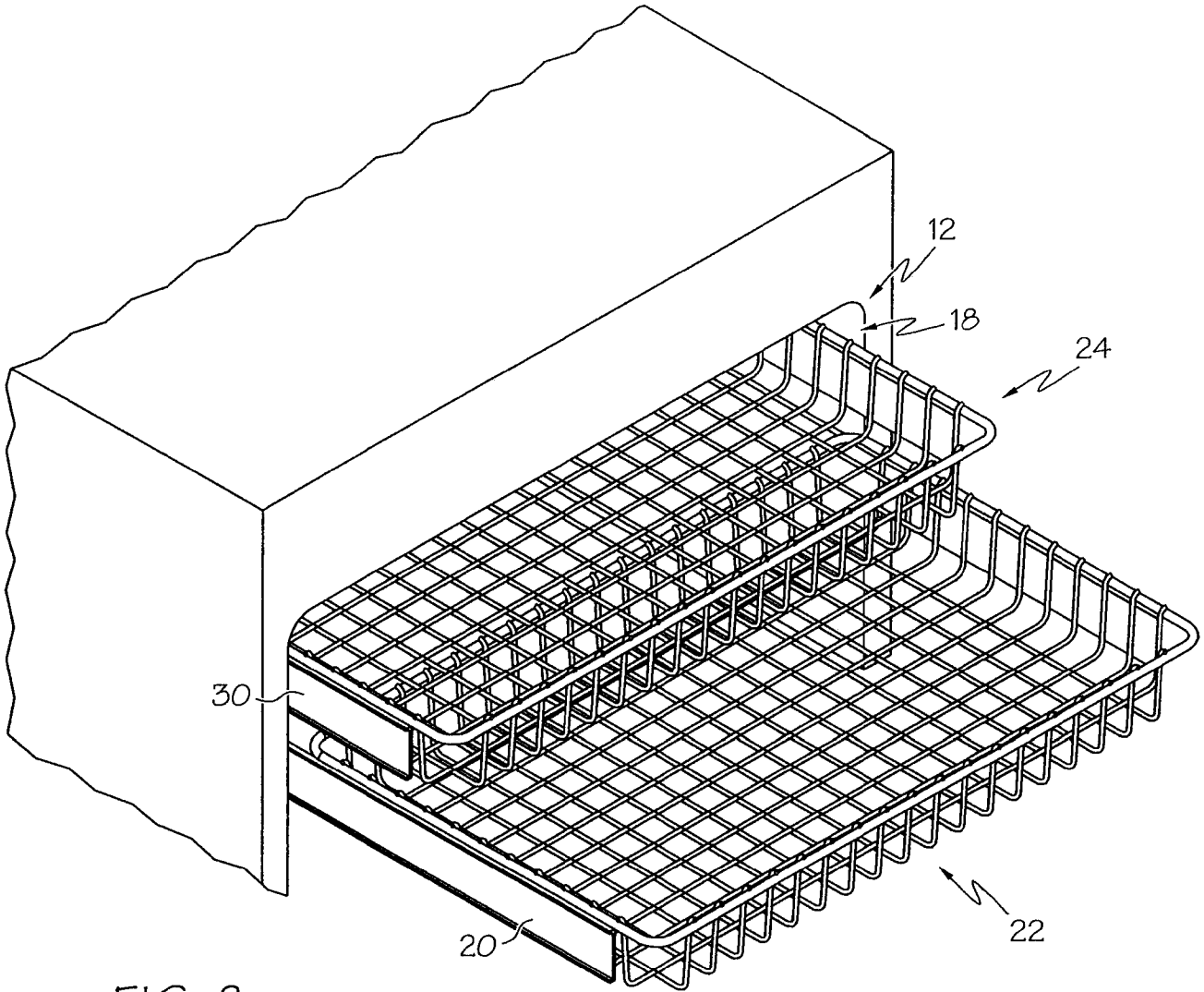
FIG. 8 is a perspective view of the first storage bin and the second storage bin of FIG. 1 removed from the storage compartment of the appliance.

As shown in FIG. 8, the first storage bin 22 can be moved from the opening 18 of the storage compartment 12 simultaneously with the second storage bin 24. The first storage bin 22 can be carried by the sliding rails 20 or by separate sliding rails that are not connected to the door 16. FIG. 8 shows an example where the second storage bin 24 is in the proper orientation such that the tabs interact with one another. Once the second storage bin 24 moves from the storage compartment 12, it becomes more visible and accessible to the consumer. The second storage bin 24 can be carried by another set of sliding rails 30. In another example, the first storage bin 22 can be pulled relatively out upon the door 16 being opened and this movement can simultaneously cause the second storage bin 24 to also be pulled relatively out of the storage compartment. It is appreciated that upon the second storage bin 24 being moved from the storage compartment 12 by the interaction between the first tab 40 and the second tab 50, the second storage bin 24 is able to be manually pushed back into the storage compartment 12 without contacting or interacting with the first tab 40 of the first storage bin 22.

Figure 9:
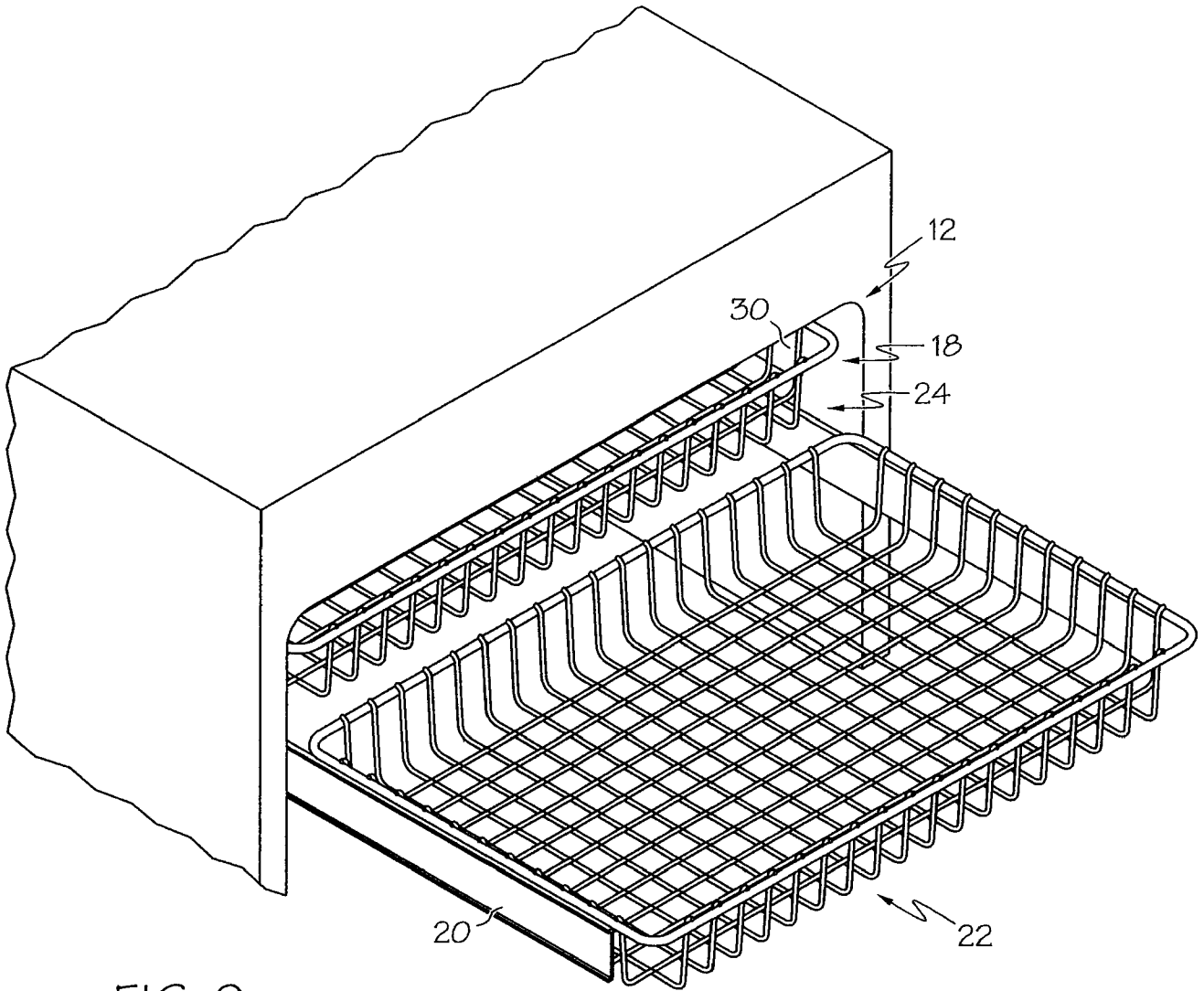
FIG. 9 is a perspective view of the first storage bin of FIG. 1 removed from the storage compartment of the appliance where the second storage bin is not moved simultaneously with the first storage bin.

In FIG. 9, the first storage bin 22 is shown while being partially moved relatively out from the opening 18 of the storage compartment 12. The first storage bin 22 can be moved from the opening 18 of the storage compartment 12 without moving the second storage bin 24. FIG. 9 illustrates the example where the user has chosen to disable the automatic movement of the second storage bin 24 by the placement of the second storage bin 24 in a second orientation. The second storage bin 24 can be subsequently moved from the opening 18 of the storage compartment. The second storage bin 24 can be configured to move relative to the storage compartment 12 along a path of movement, even while in the second orientation. In one example, the path of movement can be parallel to the movement of the first storage bin 22 that is located below the second storage bin 24. It is appreciated that the first storage bin 22 and the second storage bin 24 can have other arrangements, such as side-by-side, diagonal, etc, where different paths of movement for the storage bins 22, 24 can also be achieved. The second storage bin 24 is not visible and/or accessible when it remains within the cabinet, as shown in FIG. 9.

In any of the examples, a storage bin can be removed from a storage compartment by the movement or the kick-out of a different storage bin. In further examples, another storage bin can be located below the first storage bin 22 though it is not shown in these figures. The additional storage bin can be configured to move with the door 16. Additional storage bins can also be provided in other locations and orientations with tabs in various locations for a user to determine which storage bins will move together. Both the first storage bin 22 and the second storage bin 24 can be slidably movable with respect to a storage compartment within any type of appliance. In further examples of the subject invention, various dampers or other sound absorbing mechanisms can be provided on the tabs as well as the storage bins that can be used to reduce the noise that is created due to the interaction between the first tab 40 and the second tab 50.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. An appliance that includes a storage compartment comprising:

a first storage bin configured to move relative to the storage compartment;

a second storage bin configured to move relative to the storage compartment and relative to the first storage bin;

a first tab extending upward from a top surface of the first storage bin;

a second tab extending downward from a bottom surface of the second storage bin;

wherein the second tab is in a location that is configured to interact with the first tab along a first axis along a path of movement of the first storage bin;

wherein the second storage bin moves simultaneously with the first storage bin while the first tab interacts with the second tab;

further wherein the second storage bin is configured to be placed in the storage compartment in at least first and second horizontally coplanar orientations, wherein in the first orientation, the first tab and the second tab are configured to move coaxially along the first axis with the second storage bin moving relative to the first storage bin and in the second orientation, the first tab is configured to move along the first axis while the second tab is configured to move along a second axis that is laterally offset from the first axis such that the second tab does not interact with the first tab or first storage bin.

2. The appliance of claim 1, wherein the second storage bin is configured to move along a parallel path of movement to the first storage bin.

3. The appliance of claim 1, wherein the second storage bin is configured to move in and out of the storage compartment.

4. The appliance of claim 1, wherein the second storage bin is configured to be placed in the storage compartment in at least the first orientation and the second orientation, further wherein in the second orientation, the second tab does not engage the first storage bin or first tab such that the first storage bin and second storage bin move independently of each other.

5. The appliance of claim 4, wherein the second storage bin includes a first side, a second side, a third side, and a fourth side;

wherein the first orientation for the second storage bin includes the first side being a leading side and the fourth side being a trailing side; and wherein the second orientation for the second storage bin includes the fourth side being the leading side and the first side being the trailing side.

6. The appliance of claim 4, wherein the second tab interacts with the first tab at a point along a parallel path of movement when the second storage bin is in the first orientation.

7. The appliance of claim 1, wherein the first storage bin is configured to be placed in the storage compartment in at least first and second horizontally coplanar orientations and placement of one of the first storage bin and the second storage bin in the respective second orientation in the storage compartment disables the second storage bin from moving simultaneously with the first storage bin;

wherein the second orientation adjusts the location of one of the first tab and the second tab relative to the other of the first tab and the second tab such that the first tab and the second tab are unable to interact with each other during a parallel path of movement of the second storage bin.

8. The appliance of claim 1, wherein the first storage bin includes a first side, a second side, a third side, and a fourth side;

wherein the first storage bin is slidably movable along the second side and the third side; and wherein the first tab is located between the second side and the third side along one of the first side and the fourth side.

9. The appliance of claim 1, wherein at least one of the first storage bin and the second storage bin is a wire basket.

10. An appliance that includes a storage compartment comprising:

a first storage bin configured to move relative to the storage compartment;

a second storage bin configured to move relative to the storage compartment along a path of movement located above the first storage bin;

a first tab extending upward from a top surface of the first storage bin;

a second tab extending downward from a bottom surface of the second storage bin;

wherein the second tab is in a location that interacts with the first tab at a point along the path of movement;

wherein the second storage bin moves simultaneously with the first storage bin while the first tab interacts with the second tab;

wherein the second storage bin is configured to be placed in the storage compartment in at least first and second horizontally coplanar orientations, wherein in the second orientation, the first tab is laterally offset from the second tab within the same horizontal plane such that the first tab does not engage the second tab and the first storage bin and the second storage bin are configured to move independently of each other.

11. The appliance of claim 10, wherein the second storage bin is configured to be placed in the storage compartment in at least the first orientation and the second orientation, further wherein in the second orientation, the second tab does not contact the first storage bin or the first tab.

12. The appliance of claim 11, wherein the second storage bin includes a first side, a second side, a third side, and a fourth side;

wherein the first orientation for the second storage bin includes the first side being a leading side and the fourth side being a trailing side; and wherein the second orientation for the second storage bin includes the fourth side being the leading side and the first side being the trailing side.

13. The appliance of claim 11, wherein the second tab interacts with the first tab at the point along the path of movement when the second storage bin is in the first orientation.

14. The appliance of claim 10, wherein the first storage bin is configured to be placed in the storage compartment in at least first and second horizontally coplanar orientations and placement of one of the first storage bin and the second storage bin in the respective second orientation in the storage compartment disables the second storage bin from moving simultaneously with the first storage bin;

wherein the second orientation adjusts the location of one of the first tab and the second tab relative to the other of the first tab and the second tab such that the first tab and the second tab are unable to interact with each other during the path of movement of the second storage bin.

15. The appliance of claim 10, wherein the first storage bin includes a first side, a second side, a third side, and a fourth side;

wherein the first storage bin is slidably movable along the second side and the third side; and wherein the first tab is located between the second side and the third side along one of the first side and the fourth side.

16. The appliance of claim 10, wherein at least one of the first storage bin and the second storage bin is a wire basket.

17. An appliance that includes a storage compartment comprising:

a first storage bin configured to move relative to the storage compartment;

a second storage bin configured to move relative to the storage compartment along a parallel path of movement to the first storage bin;

a first tab extending upward from a top surface of the first storage bin;

a second tab extending downward from a bottom surface of the second storage bin;

wherein the second tab is in a location that is configured to interact with the first tab at a point along the parallel path of movement;

wherein the second storage bin moves simultaneously with the first storage bin while the first tab interacts with the second tab;

wherein the second storage bin includes a first side, a second side, a third side, and a fourth side;

wherein the second storage bin is configured to be placed in the storage compartment in at least first and second horizontally coplanar orientations;

wherein the first orientation for the second storage bin includes the first side being a leading side and the fourth side being a trailing side;

wherein the second orientation for the second storage bin includes the fourth side being the leading side and the first side being the trailing side;

wherein placement of the second storage bin in the second orientation in the storage compartment disables the second storage bin from moving simultaneously with the first storage bin and disables the first storage bin from moving simultaneously with the second storage bin; and wherein the second orientation of the second storage bin adjusts the location of the second tab relative to the first tab such that the first tab and the second tab are unable to interact with each other during the parallel path of movement of the second storage bin.

18. The appliance of claim 17, wherein the first storage bin includes a first side, a second side, a third side, and a fourth side;

wherein the first storage bin is slidably movable along the second side and the third side; and wherein the first tab is located between the second side and the third side along one of the first side and the fourth side.

19. The appliance of claim 17, wherein at least one of the first storage bin and the second storage bin is a wire basket.

* * * * *